United States Patent [19]

Yoshida

[11] Patent Number: 4,690,799

[45] Date of Patent: Sep. 1, 1987

[54] SUPERELASTIC DENTAL AU-CU-ZN ALLOYS

[75] Inventor: Takaichi Yoshida, Musashino, Japan

[73] Assignee: G-C Dental Industrial Corp., Tokyo, Japan

[21] Appl. No.: 838,949

[22] Filed: Mar. 12, 1986

[30] Foreign Application Priority Data

Apr. 2, 1985 [JP] Japan ..... 60-68531

[51] Int. Cl.[4] ..... C22C 5/02

[52] U.S. Cl. ..... 420/507; 433/207

[58] Field of Search ..... 420/507, 902; 433/207

[56] References Cited

U.S. PATENT DOCUMENTS 1,580,444 4/1926 Shields ..... 420/507

FOREIGN PATENT DOCUMENTS 189585 11/1966 U.S.S.R. ..... 420/507

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

Superelastic dental Au-Cu-Zn alloys characterizing that it is in a range defined by point A (63 wt % Au, 11 wt % Cu, 26 wt % Zn), Point B (55 wt % Au, 17 wt % Cu, 28 wt % Zn), Point C (55 wt % Au, 18 wt % Cu, 27 wt % Zn), Point D (63 wt % Au, 14 Wt % Cu, 23 wt % Zn), Point E (65 wt % Au, 12 wt % Cu, 23 wt % Zn) and Point F (65 wt % Au, 11 wt % Cu, 24 wt % Zn), in the Au-Cu-Zn ternary diagram of FIG. 1.

3 Claims, 7 Drawing Figures

SUPERELASTIC DENTAL AU-CU-ZN ALLOYS

FIELD OF THE INVENTION

The present invention relates to superelastic dental Au-Cu-Zn alloys, which is mainly best-suited for clasps.

BACKGROUND OF THE INVENTION

In dentistry, missing teeth are restored by bridges or dentures. In this case, when there is a remaining tooth, a clasp (spring) is applied to that tooth.

Such a clasp is usually formed of an about 1 mm-diameter dental wrought alloy wire made of gold alloy, gold-platinum alloy, gold-silver-palladium alloy, nickel-chromium alloy and cobalt-chromium alloy, etc. That wire is bent along the shape of the remaining tooth in the substantially round form, one end is located in the under-cut of that tooth, and the remainder end is inserted into the denture base for stabilization. Therefore, it is required to bend the dental wrought alloy wire in association with the shape of a desired clasp. However, to form the alloy wire into a compatible clasp with good dimensional accuracy is not easy, and requires rather skill. More recently, such a compatible clasp has been prepared by dental precision casting from dental casting alloys such as gold alloy, gold-platinum alloy, gold-silver-palladium alloy, nickel-chromium alloy, cobalt-chromium alloy, etc.

However, the clasps generally obtained by casting presented a problem that they suffered easier casting defects and were poorer in durability as compared with those obtained by bending of dental wrought alloy wires. Especially with nickel-chromium alloy or cobalt-chromium alloy having so high melting points that they suffer easier casting defects, breakage accidents of clasps occur frequently.

Since clasps undergo repeated elastic deformation during attachment or detachment of a denture or due to a large occlusal force exerted during occlusion. Thus, when they receive an occlusal force that is too large to allow the amount of deformation to exceed the elastic limit, they deform permanently. A lowering of the maintaining force between the dentures and clasps then takes place, so that they lose their own function. Even when such deformation is within the elastic limit, they may break due to fatigue while being exposed to repeated deformation.

SUMMARY OF THE INVENTION

In order to eliminate the problems as mentioned above, the present inventor has made intensive studies from a point of view that it may be possible to prepare high durable clasps with no fear of failure due to fatigue by selecting superelastic alloys out of alloys having shape-memory and superelastic properties, which are being studied about their possibility of being applied to dentistry, and applying superelasticity to clasps. As a result, the present inventor has paid attention to Au-Cu-Zn alloys easily prepared by dental precision casting and found to have a superelastic effect, be free from any toxicity in view of dentistry, excell in corrosion resistance in the oral mouth, and possess suitable physical properties. Among such alloys, studies have already been made of systems of x atomic % Au, (55-x) atomic % Cu and 45 atomic % Zn (hereinafter referred to as the known ternary alloys). The properties of systems wherein x is 16 to 36 atomic % have been well-known. However, the known ternary alloys are so high in hardness and low in tensile strength that they break upon being bent barely 10 to 20 degrees. Thus, such alloys do not stand up to dental use.

With the foregoing in mind, the present inventor has repeated various and extensive studies to obtain alloys having the desired properties for dental purpose by varying the proportions of three components in the aforesaid known ternary alloys, i.e., by reducing the amount of Zn and increasing the amount of Au to improve corrosion resistance in the oral mouth with varied amounts of Cu. In consequence, the present inventor has accomplished the present invention.

More specifically, the present invention provides superelastic dental Au-Cu-Zn alloys characterizing that it is in a range defined by Point A (63 wt % Au, 11 wt % Cu, 26 wt % Zn), Point B (55 wt % Au, 17 wt % Cu, 28 wt % Zn), Point C (55 wt % Au, 18 wt % Cu, 27 wt % Zn), Point D (63 wt % Au, 14 wt % Cu, 23 wt % Zn), Point E (65 wt % Au, 12 wt % Cu, 23 wt % Zn) and Point F (65 wt % Au, 11 wt % Cu, 24 wt % Zn), in the Au-Cu-Zn ternary diagram of FIG. 1.

DETAILED DESCRIPTION OF THE INVENTION

Figure 1:
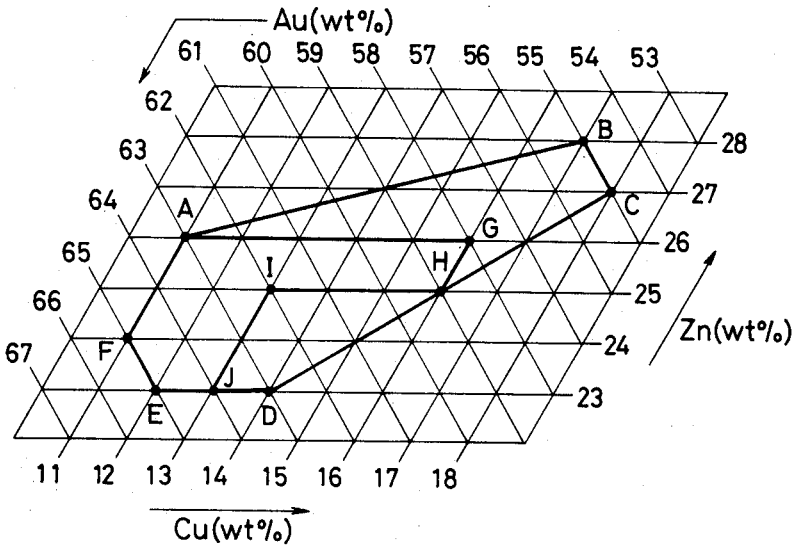
FIG. 1 illustrates a ternary diagram of Au-Cu-Zn composition for some of the alloys of the present invention encompassed within the zone defined by the boundary A-B-C-D-E-F-A.

In the following, the superelastic dental Au-Cu-Zn alloys according to the present invention will be explained in further detail.

According to the present invention, the amounts of Au, Cu and Zn in the superelastic dental Au-Cu-Zn alloys are determined on the bases of the following findings.

Au is an element that is important to improve the corrosion resistance of dental alloys in the oral mouth and bring about an superelastic effort with Cu and Zn. The corrosion resistance in the oral mouth increases in proportion to the amount of Au. However, as the amount of Au increases, a drop of hardness starts to take place at a peak of 62–64 wt %, and Au is rather expensive. Thus, the amount of Au is limited to a range of 55 to 65 wt %. Cu is an element that is necessary to limit the melting point of alloys to a relatively low value and increase the tensile strength and elongation thereof. However, as the amount of Cu increases, there is a tendency for the superelastic effect toward dropping. On the other hand, as the amount of Cu decreases, the resulting alloys have an increased melting point, and suffer a drop of amount of Zn upon being subjected to repeated casting. Thus, the amount of Cu is restricted to a range of 11 to 18 wt %. Zn is an element that combines an deoxidation effect with a castability-improving effect. However, the amount of Zn decreases, there is a tendency for the superelastic effect toward dropping, whereas as the amount of Zn increases, there are lowerings of tensile strength and elongation. Thus, the amount of this element is limited to a ragne of 23 to 28 wt %.

Within such a compositional range, 36 types of Au-Cu-Zn alloys, as set forth in Table 1, were prepared, and were tested with respect to tensile strength, elongation, hardness, tarnish in a 0.1% aqueous $Na_2S$ solution, fatigue and elasticity by visual appreciation to determine an alloy compositional range that affords superelasticity suited for the dental purpose.

The testing methods, as referred to in Table 1, are as follows.

The Au, Cu and Zn materials used were all of 99.99% or higher purity. Each starting material was weighed at the precision of 0.1 mg in such a manner that one lot contained 10 g. After the material had been placed in a molten quartz tube and substituted with an argon gas, it was formed into an alloy at a controlled temperature of 890° C. in a proportional control type high-frequency induction furnace. The thus obtained alloys were processed by ordinary dental precision casting in a centrifugal casting machine to prepare test pieces for tensile strength (1.5 mmϕ×50 mm), hardness (5×5×1 mm), fatigue (the round rod form of 0.6 mmϕ×50 mm provided at one end with a 0.3 mmϕ vent) and tarnish (10×20×0.5 mm).

The tensile strength and elongation of the test pieces were measured with a universal testing machine (Shimazu Autograph DCS-10T). A strain gauge type elongation meter (SG10-50 manufactured by Shimazu Seisakusho) was set in test piece (gauge length 10 mm). Testing was carried out at a cross-head speed of 1 mm/min.

For the measurement of hardness, the test pieces were finished with waterproof polishing paper of No. 1200. With a Vickers hardness tester (Model-AVK manufactured by Akashi Seisakusho), testing was thereafter carried out under a load of 5 kgf. Tarnish was measured in accordance with Tarnish Testing Methods JIS T6113, T6105 and T6106 provided for dental casting alloys. On the other hand, the test pieces were finished with waterproof polishing paper of No. 400, and were immersed in a 0.1% $Na_2S$ aqueous solution in a thermostatic apparatus at 37° C. for 3 days. With a ring-like xenon light source, i.e., a a C-light source and a digital type photoelectric colorimeter (Colorimeter xy-1 manufactured by Minoruta), color coordinates x, y of the C.I.E. system and visual appreciation reflectivity Y were obtained on the test pieces, and were converted into L*a*b* systems and NBS units.

Fatigue testing was effected with a constant-displacement type repeated bending testing machine made to this end. This testing machine is of the cantilever type to accommodate the displacement of a dental clasp. The power is supplied from a d.c. motor (manufactured by Tokushu Denso) having 4:1 gear head through a variable type constant-voltage device (0 to 18 V, 1 A). The motor is rotated at 0 to 360 r.p.m. by varying the output voltage. A cam, the radius of which was varied from 0 to 60 mm, was attached through a needle bearing to one end of a shaft of the gear head, which was spaced away from the fulcrum by a distance of 5:1, while a parallel type slide bar was attached through a similar needle bearing to the other end thereof. The stroke of the parallel type slide bar was varied from 0 to ±12 mm at one's disposal, while that bar was provided at the free end with a repeated bending testing jig (six types of jigs having a slot width of 0.5, 0.6, 0.7, 0.8, 0.9 and 1.0 mm). The number of repeated bending can be counted by an electromagnetic counter of six figures through a microswitch attached to the rotating shaft of the gear head, and can be done up to 990,000 times. A combination of a sensor for sensing conduction between the test piece and the bending jig with a delay relay assures that breakage of the test piece in the course of testing is detected to interrupt automatically the operation of the counter and other part. It is noted that the amount of displacement given to the test piece is measured by a micrometer, and is fixed at a certain value by the adjustment of the radius of the rotating cam. The testing conditions applied with this machine were: the length of a beam being kept constant at 10 mm, the repeating speed being 360 r.p.m., and the diplacement being kept constant ±2.0 mm.

For the measurement of elasticity, a 0.3 mm-linear cast portion of the vent attached to the test piece was bent at substantially right angles to visually appreciate the curvature and breakage thereof. The criteria used for judgement are:

@ Superelastic

○ Somewhat superelastic

Δ Deformation takes place, but recovery of 50% or lower is obtained x Large deformation takes place without recovery

* Superelastic and capable of producing a shape-memory effect

● Somewhat superelastic and capable of producing a shape-memory effect

▲ Capable of producing a shape-memory effect, and deformation takes place but a recovery of 50% or lower is obtained.

The results of testing carried out in the aforesaid manners are set forth in Table 1.

TABLE 1

| Alloy No | Composition (wt %) Au | Cu | Zn | Tensile Strength (kgf/mm²) | Elongation (%) | Hardness (Hv) | Tarnish (NBS unit) | Fatigue Repeating time | Elasticity by visual appreciation |
|---|---|---|---|---|---|---|---|---|---|
| 1 | 54 | 18 | 28 | 26.6 | 2.12 | 175 | 13.67 | 1472 | ⊙ |
| 2 | 55 | 17 | 28 | 22.5 | 1.96 | 179 | 15.00 | 1340 | ⊙ |
| 3 | 56 | 16 | 28 | 16.3 | 0.63 | 186 | 12.93 | 781 | X |
| 4 | 57 | 15 | 28 | 5.8 | 0.06 | 194 | 12.86 | 10 | X |
| 5 | 55 | 18 | 27 | 42.7 | 3.85 | 175 | 13.53 | 2611 | Δ |
| 6 | 56 | 17 | 27 | 45.8 | 3.63 | 179 | 13.84 | 1649 | ⊙ |
| 7 | 57 | 16 | 27 | 32.5 | 1.20 | 178 | 14.09 | 1528 | ⊙ |
| 8 | 58 | 15 | 27 | 18.1 | 0.52 | 190 | 12.85 | 878 | ⊙ |
| 9 | 59 | 14 | 27 | 9.0 | 0.21 | 192 | 10.60 | 46 | ⊙ |
| 10 | 56 | 18 | 26 | 45.3 | 3.72 | 171 | 13.24 | 424 | Δ |

TABLE 1-continued

| Alloy No | Composition (wt %) Au | Cu | Zn | Tensile Strength (kgf/mm²) | Elongation (%) | Hardness (Hv) | Tarnish (NBS unit) | Fatigue Repeating time | Elasticity by visual appreciation |
|---|---|---|---|---|---|---|---|---|---|
| 11 | 57 | 17 | 26 | 42.8 | 4.11 | 188 | 13.93 | 286 | * |
| 12 | 58 | 16 | 26 | 42.9 | 2.32 | 177 | 12.01 | 8713 | ⊙ |
| 13 | 59 | 15 | 26 | 33.0 | 0.91 | 183 | 10.51 | 5554 | * |
| 14 | 60 | 14 | 26 | 21.8 | 1.20 | 189 | 11.47 | 31900 | * |
| 15 | 61 | 13 | 26 | 12.6 | 0.37 | 192 | 9.70 | 5006 | ⊙ |
| 16 | 62 | 12 | 26 | 8.0 | 0.33 | 196 | 11.41 | 30991 | ⊙ |
| 17 | 63 | 11 | 26 | 18.5 | 0.61 | 187 | 12.08 | 2439 | ⊙ |
| 18 | 58 | 17 | 25 | 55.5 | 4.11 | 186 | 11.80 | 501 | X |
| 19 | 59 | 16 | 25 | 49.1 | 4.23 | 182 | 10.44 | 5283 | ⊙ |
| 20 | 60 | 15 | 25 | 45.8 | 3.83 | 181 | 10.35 | 7619 | ⊙ |
| 21 | 61 | 14 | 25 | 36.7 | 1.56 | 187 | 10.69 | 3430 | ⊙ |
| 22 | 62 | 13 | 25 | 14.4 | 0.46 | 207 | 11.80 | 5041 | ⊙ |
| 23 | 63 | 12 | 25 | 16.1 | 0.54 | 205 | 10.33 | 3795 | ⊙ |
| 24 | 64 | 11 | 25 | 26.7 | 1.24 | 185 | 10.89 | 3451 | ⊙ |
| 25 | 60 | 16 | 24 | 57.8 | 3.36 | 192 | 11.54 | 327 | ○ |
| 26 | 61 | 15 | 24 | 36.8 | 1.01 | 189 | 10.55 | 428 | ○ |
| 27 | 62 | 14 | 24 | 35.5 | 1.41 | 192 | 11.07 | 1179 | ⊙ |
| 28 | 63 | 13 | 24 | 32.2 | 1.08 | 189 | 10.13 | 5242 | ⊙ |
| 29 | 64 | 12 | 24 | 21.7 | 1.00 | 194 | 11.77 | 421758 | ⊙ |
| 30 | 65 | 11 | 24 | 19.4 | 0.86 | 178 | 10.75 | 1532 | ⊙ |
| 31 | 61 | 16 | 23 | 38.9 | 0.87 | 195 | 9.55 | 431 | ● |
| 32 | 62 | 15 | 23 | 38.3 | 1.18 | 194 | 10.37 | 1137 | ● |
| 33 | 63 | 14 | 23 | 35.5 | 1.02 | 189 | 11.19 | 1033 | ● |
| 34 | 64 | 13 | 23 | 30.5 | 1.07 | 212 | 10.33 | 6694 | ● |
| 35 | 65 | 12 | 23 | 31.1 | 2.46 | 199 | 11.04 | 1806 | ○ |
| 36 | 66 | 11 | 23 | 31.2 | 1.25 | 174 | 12.05 | 781 | ⊙ |

Figure 2:
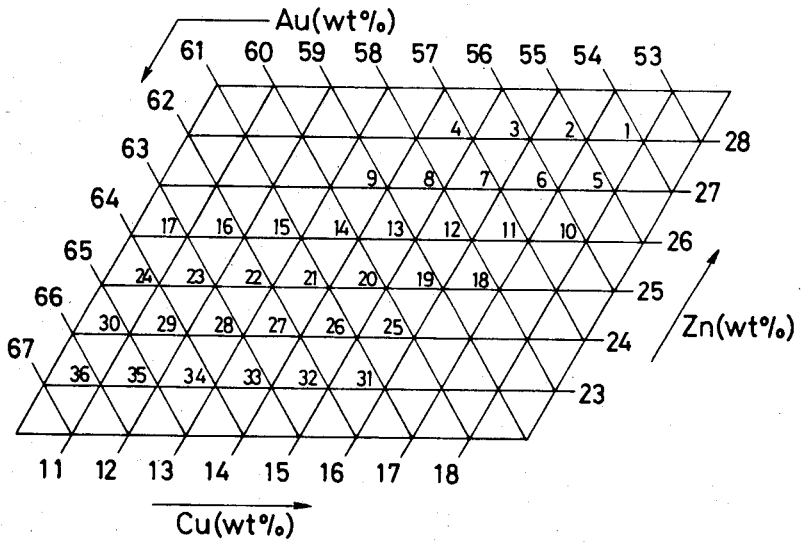
FIG. 2 illustrates a composition diagram of alloys numbered 1–36 as specified in Table 1.
Figure 3:
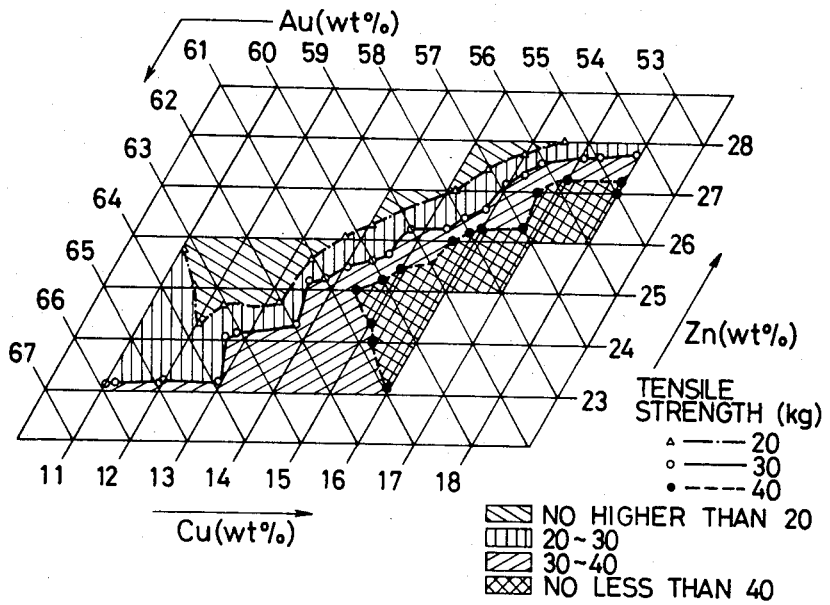
FIG. 3 illustrates a graphical view of iso-tensile strength curves based upon tensile strength tests of the present alloys.
Figure 4:
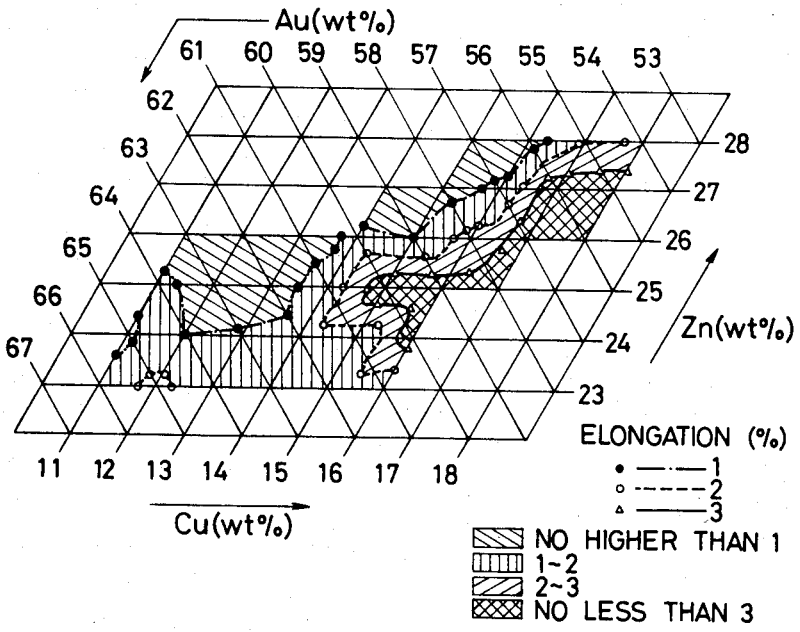
FIG. 4 illustrates a graphical view of iso-elongation curves based upon elongation tests of the present alloys.
Figure 5:
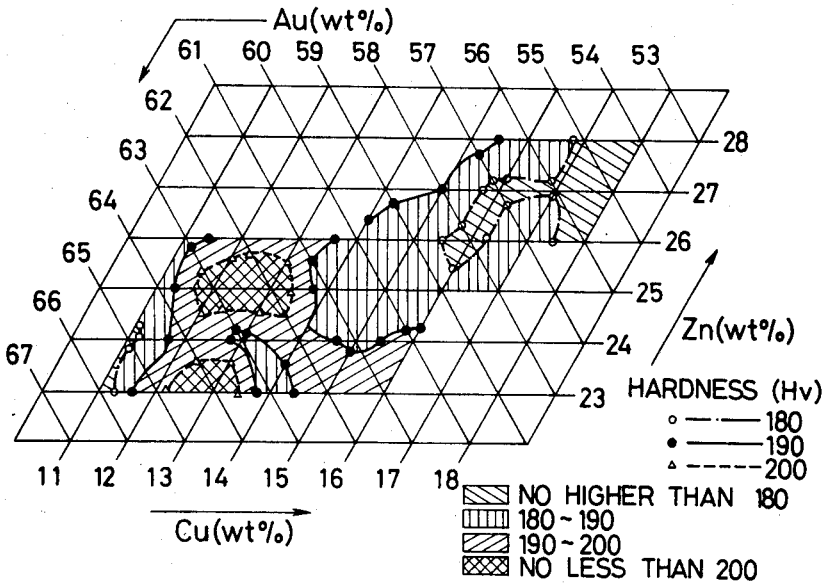
FIG. 5 illustrates a graphical view of iso-hardness curves based upon hardness tests of the present alloys.
Figure 6:
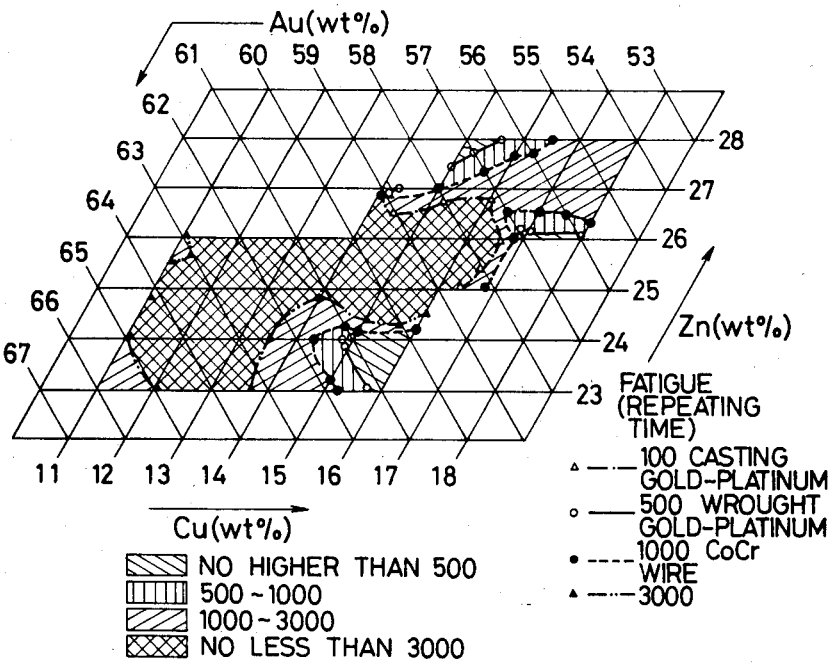
FIG. 6 illustrates a graphical view of iso-fatigue curves based upon fatigue tests of the present alloys.
Figure 7:
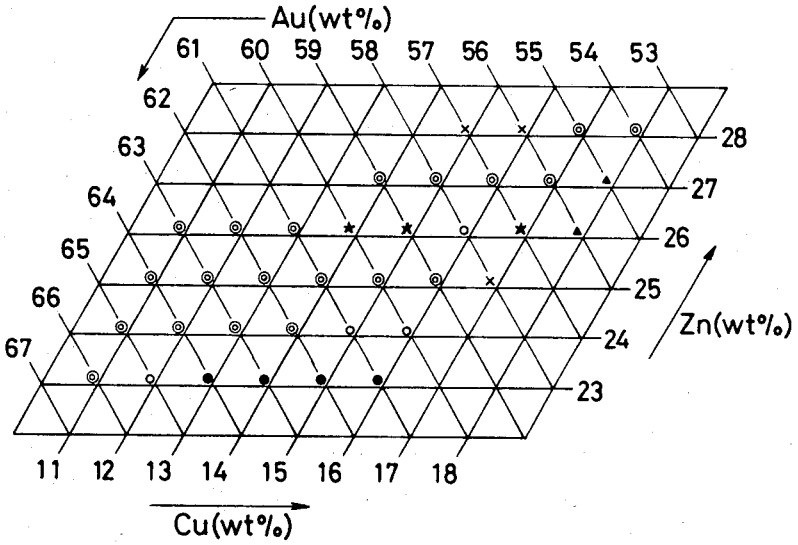
FIG. 7 illustrates a graphical representation of the visually appreciated results of elasticity.

For a better understanding of the testing results, FIG. 2 shows a composition diagram of the alloys specified in Table 1, FIG. 3 shows a graphical view of iso-tensile strength curves based on the tensile strength tests, FIG. 4 shows a graphical view of iso-elongation curves based on the elongation tests, FIG. 5 shows a graphical view of iso-hardness curves based on the hardness tests, FIG. 6 shows a graphical view of iso-fatigue curves based on the fatigue tests, and FIG. 7 shows a view of the visually appreciated results of elasticity.

As will be appreciated from FIGS. 3 and 4, the iso-tensile strength and iso-elongation curves show a similar tendency. However, the tensile strength is varied by the amounts of Cu and Zn. The tensile strength tends to increase, as the amount of Cu exceeds 15 wt % and increases to 18 wt %. When the amount of Zn is in a range of 23 to 27 wt % and the amount of Au is in a range of 55 to 61 wt %, a tensile strength of higher than 45 kgf/mm² is obtained. However, it is found that the tensile strength changes substantially in parallel with a line connecting Points C with D given in the Au-Cu-Zn ternary diagram of FIG. 1 showing the composition range of the alloys of the present invention, so that there is a certain composition, such as No. 18, which has a tensile strength of as high as 55.5 kgf/mm², but is free from superelasticity. Thus, the range of the alloys according to the present invention is defined by a region located above the line C-D in FIG. 1. It is noted that Alloy No. 4 is so poor in tensile strength and fragile that it cannot stand up to dental use. This appears to be due to the fact that it has a composition bearing resembrance to that of the aforesaid known ternary alloys.

The iso-elongation and iso-tensile strength curves, given in FIGS. 3 and 4, show a considerably similar tendency. A composition range giving high tensile strength defines a composition region giving high elongation, and the elongation curves change substantially in parallel with the line C-D in FIG. 1. It is thus ascertained that the limits imposed upon the composition range of the present alloys are reasonable.

All the present alloys have a very high hardness of no lower than Hv 170, and are considerably higher in hardness than the conventional dental alloys, e.g., 20 K gold alloys having a hardness of about Hv 80 and 18 K gold alloys having a hardness of about Hv 140. Especially, Alloy No. 35 has a very high hardness of Hv 212 and a tensile strength of as high as 30.5 kgf/mm². Thus, it is found to be best-suited for the dental purpose.

Referring to the results of tarnish testing in a 0.1% $Na_2S$ aqueous solution and more particularly to some alloys that show excellent resistance to tarnish, as expressed in terms of a smaller value, a tarnish value of 12 or higher is obtained when amount of Au is 59 wt % or lower, but a tarnish value of 11 or lower is obtained when the amount of Au is 60 wt % or higher. It is thus noted that the more the amount of Au, the smaller the tarnish value. However, it is also noted that, since such tarnish is limited to a degree that a golden color is not lost, no appreciable tarnish appears to take place in the oral mouth.

The fatigue testing is the most important one to confirm that the present alloys do not break in the application to clasps. Referring to the average fatigue-failure value for the conventional dental alloys in the same testing procedures, it is, for instance, about 100 times for the dental casting gold-platinum alloys, about 500 times for the dental wrought gold-platinum alloy wires, and about 1000 times for the dental wrought Co-Cr alloy wires, which are the most durable dental material. As evident from FIG. 6, most of the present alloys are excellent in that point over the conventional material. Especially, Alloy Nos. 12–16, 19–24, 28–29 and 34 are at least three times as much durable as the dental wrough Co-Cr alloys. Among them, Alloy No. 29 has an amazing durability of 421,758 times that is about 400 times as high as that of the dental wrought Co-Cr alloys wires. In this connection the wrought Ni-Ti alloy wire having superelasticity was tested in respect of fatigue under the same testing conditions. As a result, that wire broken 45,372 times. It is thus confirmed that the present alloys show more excellent durability over the wrought superelastic Ni-Ti alloy wires in spite of the fact that they are of a cast structure. Thus, it is possible to prepare from the superelastic alloys according to the present invention durable clasps that are difficult to break due to fatigue.

It is found from FIG. 7 showing a view of the visually appreciated results of elasticity that Alloy Nos. 3, 4, 5, 10, 18, 25, 26, 31, 32, 33 and 34 are poor in the superelastic effect, and so they are unsuitable for use in clasps. Thus, the composition range of the present alloys is defined by a region located below a line A-B in FIG. 1.

In FIG. 1, the present alloys which have compositions in a range defined by Point A (63 wt % Au, 11 wt % Cu, 26 wt % Zn), Point G (58 wt % Au, 16 wt % Cu, 26 wt % Zn), Point H (59 wt % Au, 16 wt % Cu, 25 wt % Zn), Point I (62 wt % Au, 13 wt % Cu, 25 wt % Zn), Point J (64 wt % Au, 13 wt % Cu, 23 wt % Zn), Point E (65 wt % Au, 12 wt % Cu, 23 wt % Zn) and Point F (65% Au, 11 wt % Cu, 24 wt % Zn) are particularly preferred, since they have excellent durability.

As already stated in detail, the superelastic dental Au-Cu-Zn alloys according to the present invention are easily formed into dental cast materials with good precision by means of the conventional dental precision casting processes. The present alloys are free from any toxicity in the oral mouth, excel in corrosion resistance, and have improved properties such as improved tensile strength, elongation, hardness, tarnish in 0.1% $Na_2S$ aqueous solutions, fatigue and elasticity by visual appreciation.

The clasps prepared from the present alloys by dental precision casting and applied to the denture of a patient are more durable and difficult-to-break than those obtained from the conventional dental casting alloys or dental wrought alloy wires, resulting in improvements in safety and enabling a deep under-cut of the remaining tooth to be utilized. In this manner, the stability of the denture base is markedly improved.

I claim:

1. A superelastic dental Au-Cu-Zn alloy having enhanced corrosion resistance selected from the group of alloys whose compositions are defined by the zone encompassed by the region of points 2-9-16-24-30-35-34-19-11-2 of FIG. 2.

2. The superelastic dental Au-Cu-Zn alloy as claimed in claim 1, wherein said alloy is selected from the group of alloys whose compositions of Au, Cu and Zn in wt.% are:

| Au | Cu | Zn |
|---|---|---|
| 55 | 17 | 28 |
| 56 | 17 | 27 |
| 57 | 16 | 27 |
| 58 | 15 | 27 |
| 59 | 14 | 27 |
| 57 | 17 | 26 |
| 58 | 16 | 26 |
| 59 | 15 | 26 |
| 60 | 14 | 26 |
| 61 | 13 | 26 |
| 62 | 12 | 26 |
| 59 | 16 | 25 |
| 60 | 15 | 25 |
| 61 | 14 | 25 |
| 62 | 13 | 25 |
| 63 | 12 | 25 |
| 64 | 11 | 25 |
| 62 | 14 | 24 |
| 63 | 13 | 24 |
| 64 | 12 | 24 |
| 65 | 11 | 24 |
| 64 | 13 | 23 |
| 65 | 12 | 23 |

3. The superelastic dental Au-Cu-Zn alloy as claimed in claim 2, wherein said alloy is selected from the group of alloys whose compositions of Au, Cu and Zn in wt.% are:

| Au | Cu | Zn |
|---|---|---|
| 58 | 16 | 26 |
| 59 | 15 | 26 |
| 60 | 14 | 26 |
| 61 | 13 | 26 |
| 62 | 12 | 26 |
| 59 | 16 | 25 |
| 60 | 15 | 25 |
| 61 | 14 | 25 |
| 62 | 13 | 25 |
| 63 | 12 | 25 |
| 64 | 11 | 25 |
| 63 | 13 | 24 |
| 64 | 12 | 24 |
| 64 | 13 | 23 |

* * * * *